US005587884A

United States Patent [19]

Raman

[11] Patent Number: 5,587,884

[45] Date of Patent: Dec. 24, 1996

[54] ELECTRICAL CONNECTOR JACK WITH ENCAPSULATED SIGNAL CONDITIONING COMPONENTS

[75] Inventor: Venkat A. Raman, Hershey, Pa.

[73] Assignee: The Whitaker Corporation, Wilmington, Del.

[21] Appl. No.: 384,086

[22] Filed: Feb. 6, 1995

[51] Int. Cl.[6] ..... H01R 13/66

[52] U.S. Cl. ..... 361/728; 439/620

[58] Field of Search ..... 361/728, 736, 361/738, 740, 741, 747, 784, 785, 789, 803; 439/637, 620, 79, 676, 607

[56] References Cited

U.S. PATENT DOCUMENTS

| | | | |
|---|---|---|---|
| 3,850,497 | 11/1974 | Krumreich et al. . | |
| 4,047,242 | 9/1977 | Jakob et al. | 361/389 |
| 4,193,654 | 3/1980 | Hughes et al. . | |
| 4,202,593 | 5/1980 | Abernethy et al. . | |
| 4,261,633 | 4/1981 | Abernethy . | |
| 4,274,691 | 6/1981 | Abernethy et al. . | |
| 4,329,665 | 5/1982 | Kawai et al. | 333/182 |
| 4,600,256 | 7/1986 | Anttila . | |
| 4,602,122 | 7/1986 | Lint | 174/52 R |
| 4,618,207 | 10/1986 | Silbernagel . | |
| 4,695,115 | 9/1987 | Talend | 439/76 |
| 4,698,025 | 10/1987 | Silbernagel et al. | 439/79 |
| 4,699,595 | 10/1987 | Nakazawa et al. | 439/676 |
| 4,703,991 | 11/1987 | Philippson | 439/676 |
| 4,720,155 | 1/1988 | Schildkraut et al. | 439/108 |
| 4,726,638 | 2/1988 | Farrar et al. | 439/620 R |
| 4,726,790 | 2/1988 | Hadjis | 439/620 |
| 4,729,752 | 3/1988 | Dawson, Jr. et al. | 439/620 |
| 4,758,921 | 7/1988 | Hung | 361/119 |
| 4,772,224 | 9/1988 | Talend | 439/620 X |

(List continued on next page.)

FOREIGN PATENT DOCUMENTS

| | | | |
|---|---|---|---|
| 0262339 | 6/1988 | European Pat. Off. . | |
| 0413978A2 | 2/1991 | European Pat. Off. . | |
| 3841351A1 | 6/1990 | Germany . | |
| 1-128380 | 5/1989 | Japan | 439/620 |
| 2-267879 | 11/1990 | Japan | 439/260 |
| 2169157 | 7/1986 | United Kingdom . | |
| WO87/07775 | 12/1987 | WIPO . | |

OTHER PUBLICATIONS

International Search Report.
AMP Customer Drawing 555694 dated May 31, 1991.
AMP Customer Drawing 557573 dated Jun. 15, 1992.
AMP Customer Drawing 554269 dated Feb. 2, 1984.
AMP Standard Products Catalog p. 737, 4th Ed. Issued Mar. 1985.
AMP Customer Drawing 557562, dated Jun. 8, 1992.

*Primary Examiner*—Donald A. Sparks

[57] ABSTRACT

A modular jack electrical connector assembly 2 suitable for conditioning the signals in unshielded twisted pair wires for use with network components is disclosed. The modular jack 2 comprises a conventional insulative housing 4 and an insert subassembly 6 including insert molded front insert member 8 and rear insert member 10. Contact terminals 12 for mating with a modular plug extend from the front insert member 8 and into the rear insert member 10. The rear insert member 10 also includes signal conditioning components such as common mode choke coils 38, filter circuits 40 and transformers 54 suitable for conditioning the twisted pair signals for used in applications such as for input to and output from IEEE 10 Base-T network components. The insert molded body 30 of the rear insert member encapsulates the signal conditioning components to protect the components and to stabilize the component to achieve reliable repeatable performance. The insert molded body also stabilizes the position of the contact terminals 12 and leads 14 extending from the rear insert member 10 for attachment to external circuits, such as the external printed circuit board containing the interface processor for the specific application. The signal conditioning components can be soldered directly to the contact terminals 12 and leads 14 or they can be mounted on a signal conditioning printed circuit board 36 also encapsulated in the insert molded rear insert body 30.

1 Claim, 9 Drawing Sheets

U.S. PATENT DOCUMENTS

| | | | |
|---|---|---|---|
| 4,782,310 | 11/1988 | Saburi et al. | 333/167 |
| 4,786,259 | 11/1988 | Paul | 439/344 |
| 4,789,847 | 12/1988 | Sakamoto et al. | 333/185 |
| 4,799,901 | 1/1989 | Pirc | 439/620 |
| 4,804,332 | 2/1989 | Pirc | 439/620 |
| 4,878,848 | 11/1989 | Ingalsbe | 439/76 |
| 4,930,200 | 6/1990 | Brush, Jr. et al. | 29/25.42 |
| 4,937,464 | 6/1990 | Nanba et al. | 307/112 |
| 4,950,169 | 8/1990 | Martin et al. | 439/44 |
| 5,015,204 | 5/1991 | Sakamoto et al. | 439/620 |
| 5,040,097 | 8/1991 | Stribel | 361/395 |
| 5,069,641 | 12/1991 | Sakamoto et al. | 439/620 |
| 5,078,609 | 1/1992 | Bouchan et al. | 439/43 |
| 5,139,442 | 8/1992 | Sakamoto et al. | 439/620 |
| 5,157,580 | 10/1992 | Hegner et al. | 361/119 |
| 5,178,563 | 1/1993 | Reed | 439/676 |
| 5,240,436 | 8/1993 | Bradley et al. | 439/654 |
| 5,254,973 | 10/1993 | Gilmore, II | 340/547 |
| 5,260,994 | 11/1993 | Suffi | 379/399 |
| 5,282,759 | 2/1994 | Sakamoto et al. | 439/620 |
| 5,362,257 | 11/1994 | Neal et al. | 439/676 |
| 5,403,207 | 4/1995 | Briones | 439/620 |
| 5,456,619 | 10/1995 | Belopolsky et al. | 439/620 |

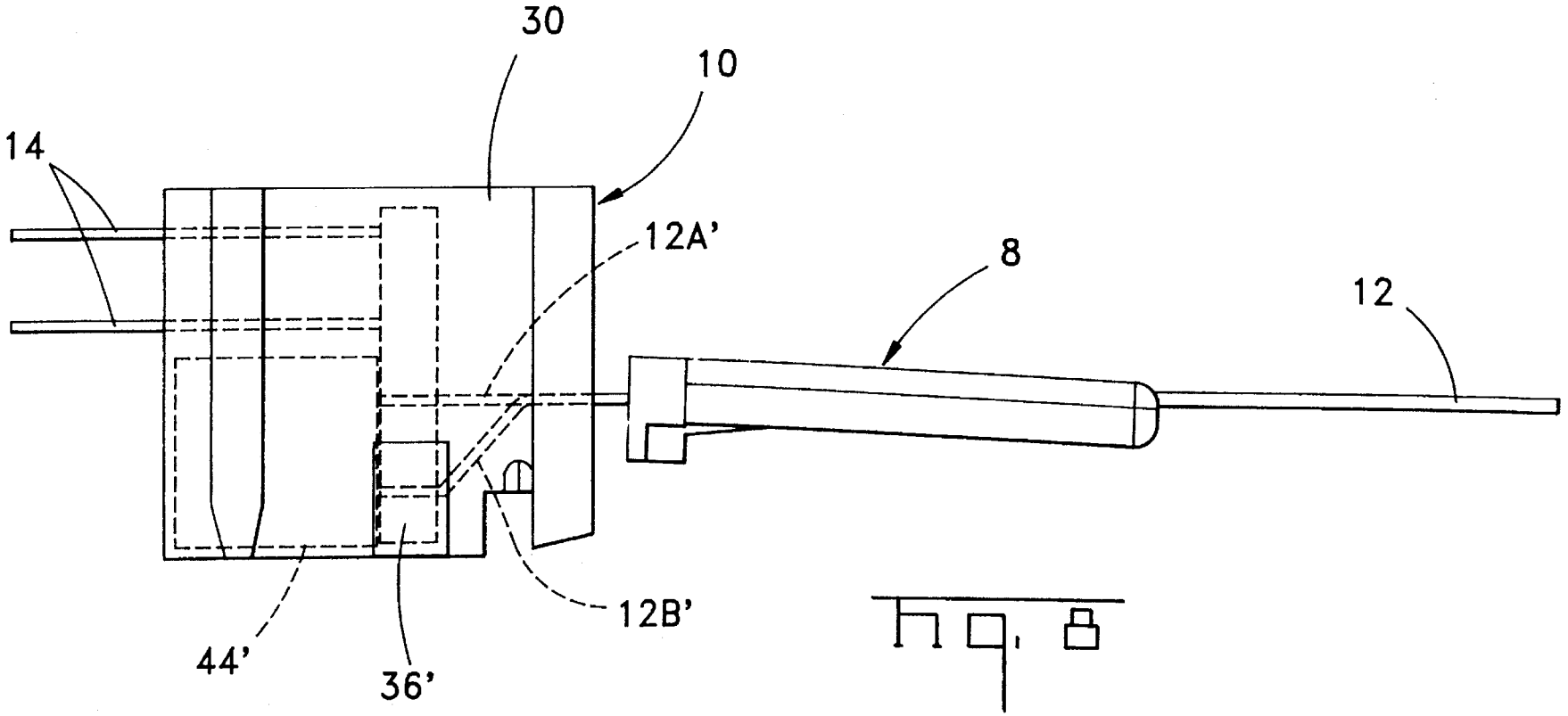
12
8
10
30
12A'
12B'
36'
44'
14

ELECTRICAL CONNECTOR JACK WITH ENCAPSULATED SIGNAL CONDITIONING COMPONENTS

FIELD OF THE INVENTION

This invention relates to electrical connectors, such as modular jack configurations used with twisted pair cable in telecommunications and networking applications. Furthermore, this invention is related to modular jack assemblies which include signal conditioning subassemblies for eliminating undesirable extraneous signals, such as high frequency noise, common mode noise and dc voltage from twisted pair lines before output by the modular jack assembly.

DESCRIPTION OF THE PRIOR ART

BACKGROUND OF THE INVENTION

Twisted pair wires are simple and inexpensive and therefore perhaps the most commonly used type of cable for low voltage signal transmission. The most common use of twisted pair wires is in telephone circuits. Unused twisted pair telephone cable currently installed in buildings is however often adequate for applications other than telephone circuits, such as for local area networks. For example, IEEE 802.3 10 Base T (Twisted Pair Ethernet) local area networks and 4 and 16 Mbps token ring local area networks can use unshielded twisted pair cable. For new installations, unshielded twisted pair cable is less expensive than coaxial cable or shielded twisted pair cable. Technicians also have significant twisted pair installation experience.

Use of twisted pair cable for many network applications requires signal conditioning or noise suppression. Common mode chokes, isolation transformers and filters, or some combination of one or more of these three, are often necessary. Chokes provide common mode rejection. The transformers provide dc isolation and impedance matching. LC filters can be used to filter out high frequency noise. Typically, these signal or line conditioning components and simple circuits are located on the network node or hub board to which the twisted pair cable is attached. Some form of standard modular jack or modular telephone jack is used to connect the cable to the node or hub printed circuit board. One specified interconnection for 10Base T networks, or the medium dependent interface connector, is an eight position modular jack, which is referred to as a RJ-45 jack. These signal conditioning or noise suppression components are conventionally located on the printed circuit board between the connector and the processor used in the hub, medium attachment unit, transceiver circuit, multiport repeater, node or other network unit. Transmit and receive lines can each require signal conditioning. A large number of processors are available for such applications. For example, the Intel 82504 can be used in the analog front end of a 10Base T node. These signal conditioning components can be discretely mounted on printed circuit boards or they can be manufactured as a separate subassembly which can then be mounted on a printed circuit board. These separate subassemblies can include chokes, chokes plus transformers, or they can be choke, transformer, filter subassemblies.

Although existing local area networks can require this type of signal conditioning or noise suppression, some form of signal conditioning is often necessary for other applications. For example, telephone circuits can require common mode chokes. For higher performance systems currently under consideration, such as 100 mbps local area networks, even more sophisticated signal conditioning or noise suppression will be necessary.

There have been a number of prior art electrical connectors which have incorporated the connector and a filtering circuit into one subassembly. U.S. Pat. No. 4,726,638 is one example of a modular telephone jack with discrete diodes between each lead and ground. These diodes are mounted on a small printed circuit board. A slot on the back of the modular telephone jack housing receives the printed circuit board, which is positioned parallel to the bottom of the telephone jack. Each telephone jack lead is soldered to the printed circuit board at the rear. The diodes are mounted between each lead and ground and not between the ends of the lead, so it is not necessary to separate the lead when it is soldered to the printed circuit board.

A subassembly of an electrical connector and a signal conditioning circuit offers several advantages. Printed circuit board real estate on the main hub or node board is conserved because additional circuitry is now located within the connector foot print or in a space less than the sum of the space otherwise occupied by the connector and separate signal conditioning circuitry. Final assembly of the main printed circuit board requires fewer components. The printed circuit board conductors is also shorter and should therefore be less susceptible to external noise.

The connector subassembly of U.S. Pat. No. 4,726,638 includes, however, a relatively simple noise suppression circuit. For applications such as local area networks, multiple components are needed on multiple lines. The size of the substrate on which these multiple components are mounted must remain relatively small, if all of the advantages of this subassembly are retained. Mutual interference between signal conditioning components may also be a problem and the placement of the various electronic components can be quite critical. Placement is a problem, even for prior art devices in which the signal conditioning components are placed on the printed circuit board. In order to maintain proper component placement in such assemblies, it is common practice to mechanically fix components in place. These components can be mechanically fixed in place by potting the components with an epoxy, or other bonding agent, or by insert molding a number of components into on physical subassembly.

Insert molding is used in other applications to retain electrical elements in position. For example, U.S. Pat. No. 5,362,257 discloses an eight conductor modular jack assembly in which crossing leads are maintained in position by insert molding plastic around the leads. Insert molding is also used to encapsulate many standard integrated circuit components. The modular jack disclosed in U.S. Pat. No. 5,362,257 also comprises an easily assembled two component assembly in which an insert molded lead subassembly is mated with a separate housing assembly.

Other modular jack subassemblies incorporating chokes in a telephone jack housing are shown in U.S. Pat. No. 5,015,204 and U.S. Pat. No. 5,069,641. U.S. Pat. No. 5,015,204 discloses a modular jack assembly in which jack leads are wound around a choke coil. U.S. Pat. No. 5,069,641 discloses a modification of this other patent in which the choke coil and lead segments are soldered to a printed circuit board. This printed circuit board assembly is then encased in an insulating housing consisting of a base and a lid and having two internal chambers. The choke coil printed circuit board is mounted in one chamber which is separated by a separator from a chamber adapted to receive a modular plug.

This latter device is assembled by inserting the choke coil printed circuit board subassembly in the housing and inserting the terminal leads through the bottom of the housing base. The contactor on the opposite end extends over the separator into the plug receiving chamber. A lid is then attached to encase the choke coil printed circuit board subassembly. Although this patent depicts only the use of a choke coil, it does suggest that chip inductors and chip capacitors, etc. could also be used.

None of these prior art devices depict a modular jack assembly suitable for use in a broad range of network applications and suitable for use at frequencies such as those encountered in 10 Base T, token ring, or networks having even higher data rates, such as proposed 100 Mhtz. networks. None of these devices show a network jack assembly in which chokes, chokes and transformers, or choke, transformer, filter combinations can be positioned in series with multiple leads in a modular jack. None of these devices depict a network jack assembly in which each of these multiple components can be precisely positioned and in which that precise positioning can be maintained over the life of the device to insure that consistent electrical performance can be achieved among multiple devices and over the life of a single device. None of these devices provide for a dielectric medium, other than air, that surrounds the electronic components, that improve the signal conditioning performance. None of these devices show a modular jack assembly in which the electronic components can be protected. None of these devices disclose a modular jack assembly which can be fabricated by positioning the components on a small printed circuit board, insert molding this printed circuit board subassembly to fix and protect the components and then mating this insert molded subassembly with a modular jack housing having a profile for receiving a modular plug. An assembly having all of these features would be more easily assembled than, for example the assembly of U.S. Pat. No. 5,069,641. The insert molded subassembly would also stabilize the position of the leads, which would not have to be inserted in holes in the bottom of the housing to provide sufficiently precise positioning for lead placement in printed circuit board plated through holes or on surface mount pads. A separate encapsulation operation would also be eliminated. Although not addressed in U.S. Pat. No. 5,069,641, adaptation of that approach to 10 Base T and Token Ring applications would require encapsulation of the components by insert molding or potting them prior to assembly in the housing, or by potting the printed circuit board subassembly after insertion in the housing chamber.

A modular jack assembly overcoming the shortcomings of the prior art is disclosed in U.S. patent application Ser. No. 08/384,085 entitled Electrical Connector Jack Assembly for Signal Transmission filed in the name of Peter Scheer and Venkat Raman on the same date as this application. That assembly employs a component printed circuit board subassembly that can be inserted in a rear insert member which is inserted into the same housing disclosed in this patent specification.

SUMMARY OF THE INVENTION

These shortcomings of the prior art and other deficiencies are addressed by this invention in which signal conditioning is included in a modular jack assembly which can be mounted on a network component interface card or printed circuit board. This invention conditions the signals carried by media, such as unshielded twisted pair wires, that would not otherwise be suitable for use with that network component. The modular jack assembly includes a housing having a cavity for receiving a conventional modular plug attached to the wires. In the preferred embodiments, this housing is a conventional housing suitable for use with unshielded twisted pair wires in more conventional applications. An insert molded subassembly mates with the housing. This insert molded subassembly includes front and rear insert members. Contact terminals extend from the front insert member into the plug receiving cavity to mate with the modular plug. These contact terminals also extend from the front insert member into the rear insert member. Signal conditioning components, such as choke coils, transformers and LC filters can be encapsulated in the rear insert member which mates in a rear open ended channel on the modular jack housing. The rear insert member is insert molded so that molded plastic completely surrounds the signal conditioning components and the portions of the contact terminals extending into the rear insert member. Leads for connecting the modular jack assembly to external circuits also extend from the rear insert member. For example, printed circuit board leads can extend from the rear insert member in footprint for connection to an external printed circuit board or interface card. The signal conditioning components can be soldered directly to corresponding contact terminals and leads or to signal conditioning printed circuit boards on which the signal conditioning components have been mounted.

By mounting the signal conditioning components in the modular jack assembly, better performance can be achieved. Adverse noise effects can be eliminated at the I/O or connector stage rather than being transmitted to other system components. The length of signal traces susceptible to external radiation is also reduced.

Insert molding represents the preferred, but not necessarily the only means of encapsulating the signal conditioning components. Advantages of encapsulating these components include holding the signal conditioning components in place, which can be essential for reliable electrical performance. Handling will not disturb the position of electronic components with respect to each other and to the pins. Encapsulation can increase the expected life of the product. Isolation or hi-pot (high voltage) requirements are more easily met with a high "K" value dielectric than with air. Encapsulation also minimizes contamination of components by chemicals used in cleaning steps after the connector is soldered to a printed circuit board. Encapsulation also minimizes changes in the electrical properties of components due to ambient moisture.

BRIEF DESCRIPTION OF THE INVENTION

FIG. 3 is a view of a conventional modular jack housing with a comb for positioning the contact terminals and an open ended rear channel in which the signal conditioning insert member is mounted.

FIG. 8 is a view, similar to FIG. 5, of a second embodiment of this invention in which the position of the terminal leads and the location of the signal conditioning components is different from that shown in the embodiment of FIG. 5.

DETAILED DESCRIPTION OF THE PREFERRED EMBODIMENTS

The four embodiments of this invention described herein represent the basic elements of this invention, which can be incorporated in other configurations not specifically shown. These representative embodiments will described with reference to specific applications, such as IEEE 802.3 10Base T (twisted pair Ethernet) local area networks, but these applications are similarly intended to be only representative. Other applications including but not limited to telecommunications, local area networks, such as twisted pair token ring or twisted pair FDDI, or other twisted pair applications can also employ this invention. Although typically used with twisted pair cable, modular jacks can also be used with untwisted pair conductors, and this invention could also be suitable for improving the signal transmission performance of untwisted wires. Indeed this invention would be suitable for any application in which signal conditioning is required so that the signals transmitted by the cable could be utilized by the device to which it is attached. The signal conditioning which can be implemented by this invention is primarily related to the removal of noise, but the term signal conditioning as used herein is not to be so limited. Signal conditioning can include, but is not limited to, the removal of high frequency noise, common or differential mode noise, and signal conditioning can also include impedance matching and voltage isolation, cross talk suppression, step down and step up transformers and achieving Category 5 twisted pair cable performance. This invention could also be used to permit the substitution of unshielded twisted pair for shielded twisted pair conductors for applications such as token ring networks.

Figure 1:
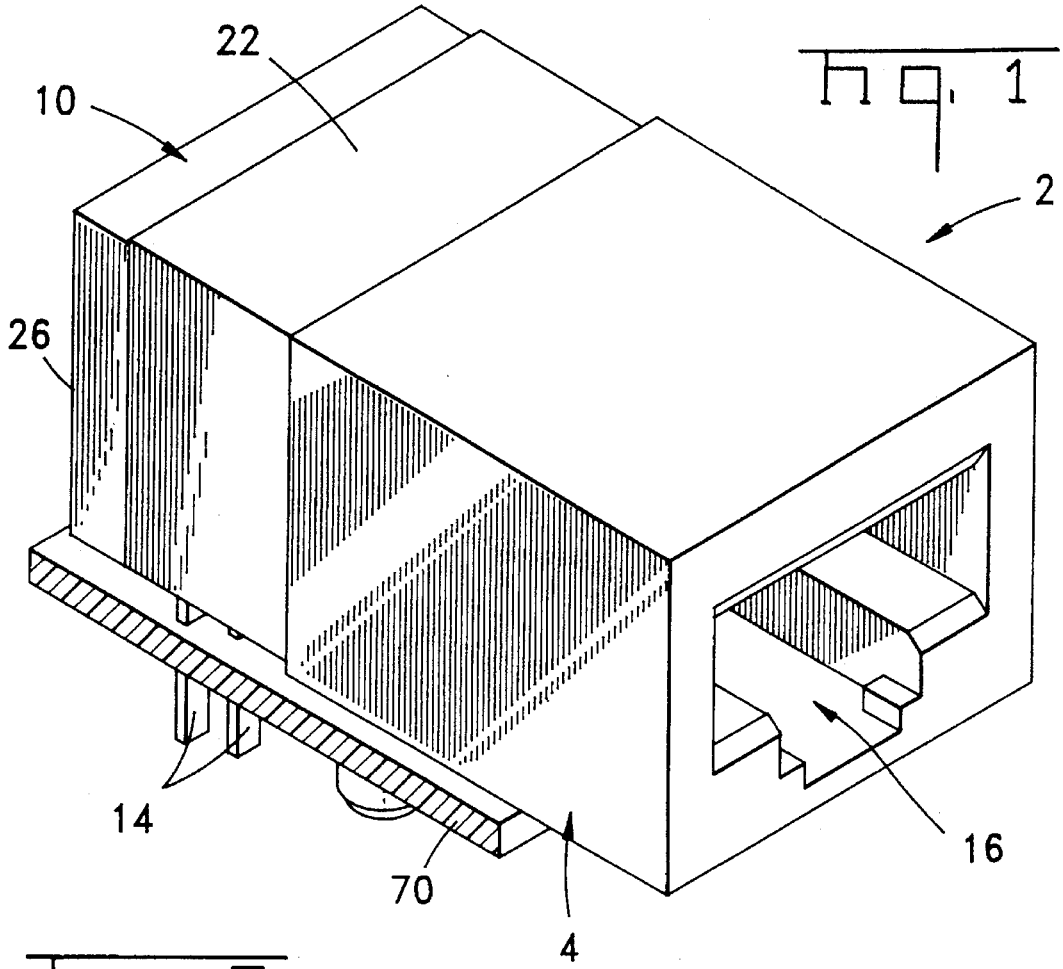
FIG. 1 is a perspective view of a printed circuit board mounted modular jack electrical connector assembly, including a signal conditioning insert member.
Figure 2:
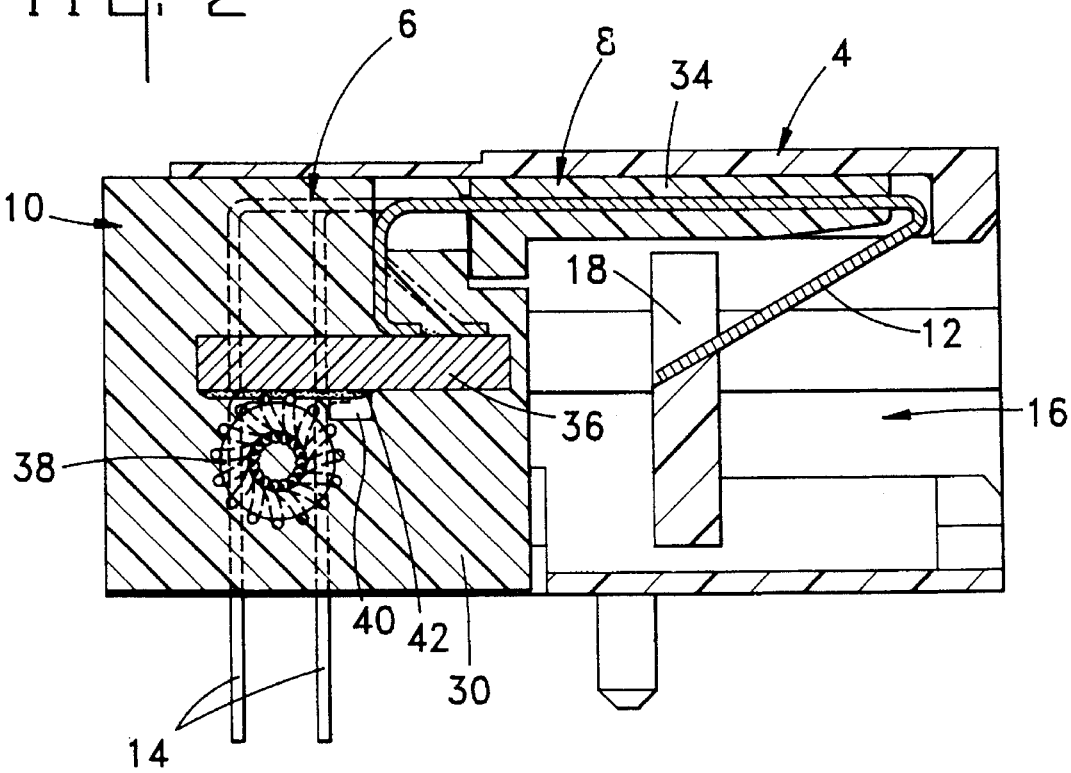
FIG. 2 is a sectional view of the modular jack connector showing a signal conditioning insert member including at least one choke coil and one surface mount filter component.

As shown in FIG. 1 this invention takes the form of a modular jack 2. Modular jacks are a common interface for twisted wires. Although originally intended for use in telephone applications, modular jacks are now used in a number of applications, especially for twisted pair local area networks. Several different modular jack versions are available and this invention can be used with each. Six conductor or RJ-11 jacks are used in some applications and eight conductor or RJ-45 jacks are used in others, such as 10Base T applications. This invention can be used not only with modular jack configurations, but with similar jack configurations, such as the shielded data link jack supplied by AMP Incorporated. This invention can also be used with multi-gang modular jacks in which more than one six or eight position terminal array is mounted in one or more rows of a single housing, having more than one plug mounting cavity, to integrate a plurality of modular jacks into one assembly.

The modular jack 2, shown in the representative embodiments is an eight position or RJ-45 modular jack. Modular jack 2 comprises a housing 4 with eight leads or terminals positioned side by side on the plug mating end of the modular jack and offset in a conventional staggered footprint at the rear end where the jack is mated with the external printed circuit board on which it is mounted. Although each of the modular jack embodiments depicted herein is intended for use on a printed circuit board, this feature is not limiting. Modular jacks which can be attached to cables at the rear end can also employ this invention.

Modular jack 2 has a conventional plug mating cavity 16 at the front end of the housing 4 and a rearwardly facing open ended channel 20 at the rear end of the housing 4. This modular jack 2 is a right angle or side entry jack in which the plug mating cavity 16 and the channel 20 extend between the upper surface of the housing 4 and a lower surface that is positioned on top of an external printed circuit board. This plug mating cavity 16 is dimensioned to receive an eight position modular plug, which is of conventional construction and is therefore not shown. The modular jack housing 4 is also of conventional construction. The same housing used for the modular jack depicted in U.S. Pat. No. 5,362,257 is also used in the modular jack 2 depicted herein. It should be noted that the same housing could also be used for a six position jack configuration. Although one of the advantages of this invention is that it can be used with a conventional housing, the invention is not limited to use with this conventional housing. For example this invention could be used with a housing in which the plug mating cavity was oriented perpendicular to the printed circuit board (a top entry configuration) instead of the right angle position (side entry configuration) of the disclosed embodiments.

An insert subassembly 6 is used to position the leads or terminals in the housing 4. The insert subassembly 6 comprises a front insert member 8 and a rear insert member 10. In this specification "insert" is used in two different contexts. Insert molding refers to the conventional technique, such as injection molding, in which plastic is molded around one or more components mounted in a mold. As used herein, the terms insert subassembly 6, front insert member 8, rear insert member 10 and insert body, refer to the subcomponents which are mated with the housing 4. The use of the terms insert subassembly, insert member and insert body in this application should be distinguished from the use of the term "inserts" to refer to the components, such as fasteners, supports or other metal components, mounted in a mold during an injection molding process. Contact terminals 12 are positioned in the front insert member 8 and extend into the rear insert member 10. Leads 14 extend from the opposite end of the rear insert member 10 to form an electrical interconnection with external circuits. In the preferred embodiments of this invention, these external circuits are located on an external printed circuit board 70 on which the modular jack 2 is mounted. The leads 14 comprise printed circuit board leads in the form of through hole leads shown in each of the embodiments depicted herein or in the form of other standard printed circuit board terminal connections, such as in the form of surface mount leads.

Figure 4:
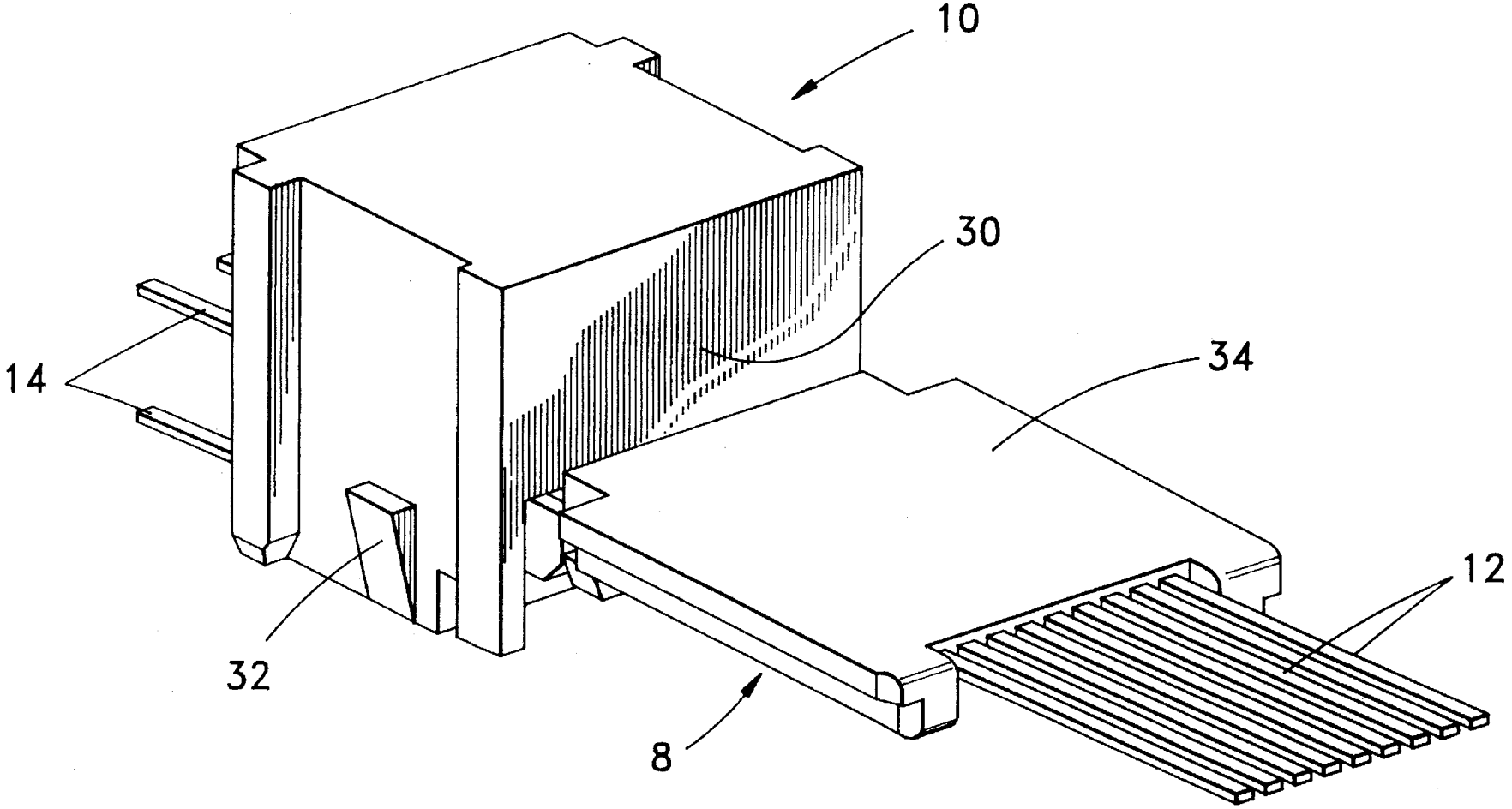
FIG. 4 is a perspective view of the insert member subassembly showing the front and rear insert members in the configuration in which this subassembly is insert molded.
Figure 7:
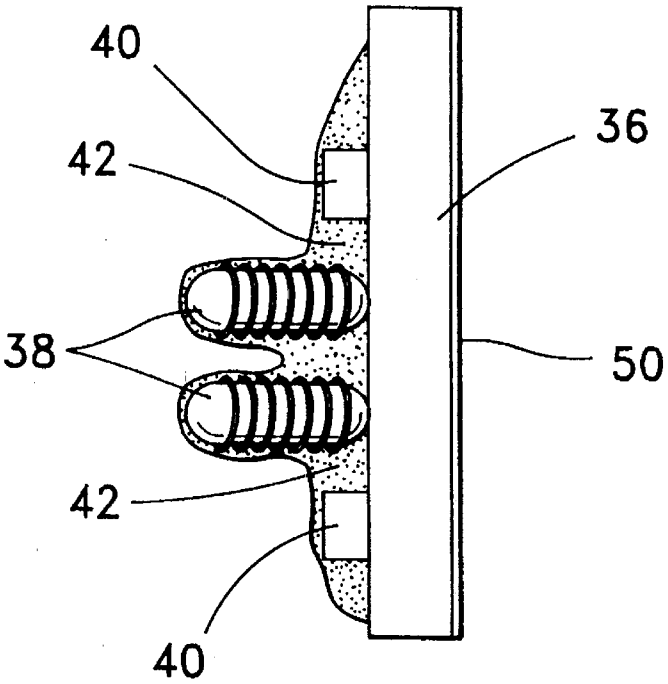

The contact terminals 12 and the leads 14 employed in the preferred embodiments are stamped and formed leads. These stamped and formed leads are fabricated from a conventional spring metal, such as phosphor bronze, and plated in the same conventional manner used with prior art modular jacks using stamped and formed leads. The contact terminals 12 and the leads 14 are positioned in a mold where the front insert member 8 and the rear insert member 10 are formed by insert molding plastic around the contact terminals 12 and the leads 14. As part of this insert molding operation, front insert member body 34 and rear insert body 30, are simultaneously formed as part of the same operation. These bodies, which encapsulate portions of the contact terminals 12 and the leads 14, can be fabricated from a thermoplastic, suitable for injection molding. A liquid crystal polymer, such as Vectra manufactured by Hoechst Celanese can be used. The contact terminals 12 and the leads 14 are in the configuration shown in FIG. 4 after this insert molding operation.

The insert subassembly 6 can be positioned in the housing 4 by partially inserting the insert subassembly 6 into the rear of the housing 4. The housing has an open ended channel 20 located at the rear end opposite from the plug mating cavity 16. See FIG. 3. This rear channel 20 is open at the back and along the rear of the bottom of the housing. A top wall 22 and two sidewalls 24, 26, each of which is integral with the housing 4 form this open ended rear channel 20. The channel 20 communicates with the front plug mating cavity 16. A comb 18, including a plurality of slots for separating the side by side contact terminals 12, is located between the rear channel 20 and the plug mating cavity 16.

Figures 13, 14:
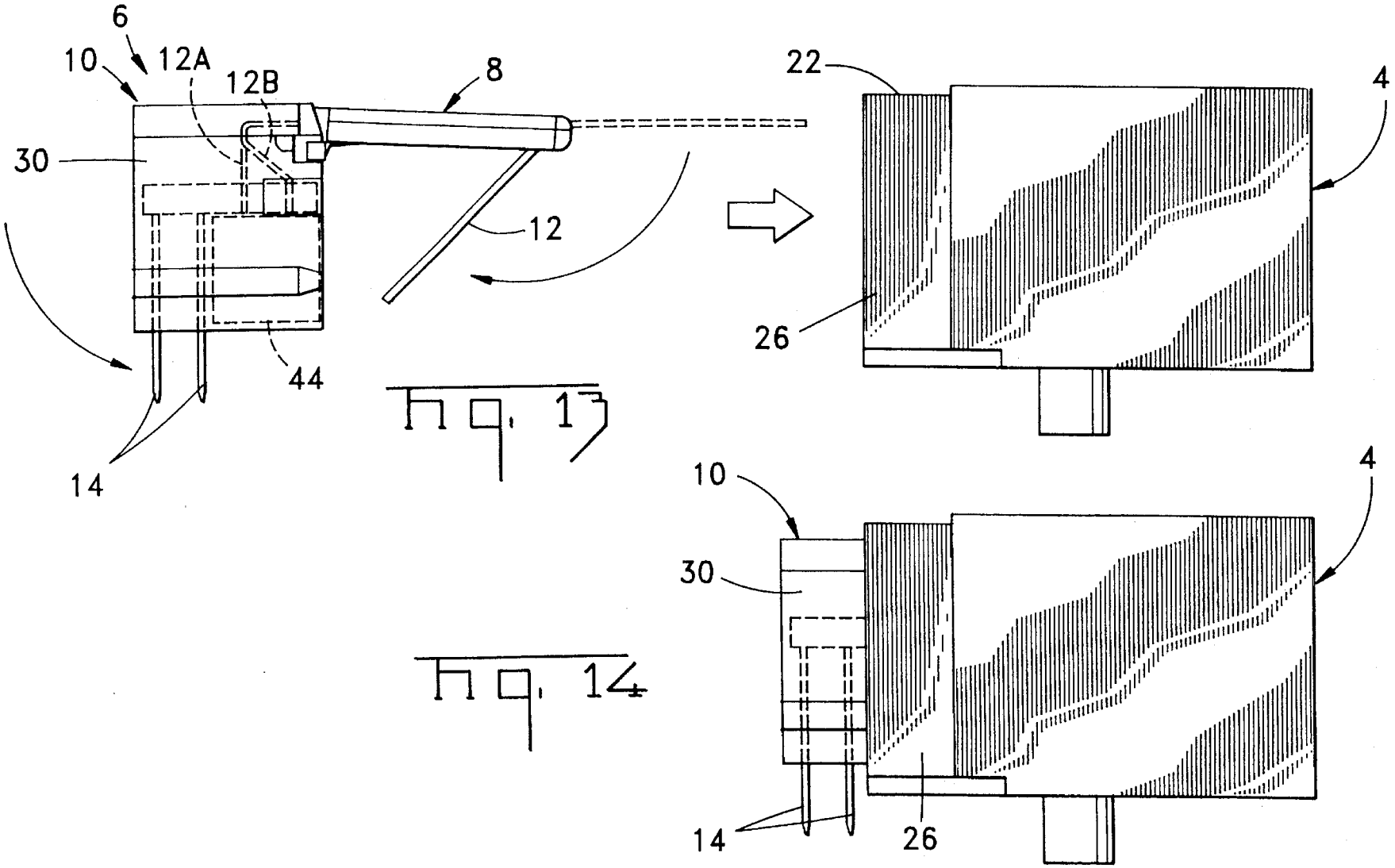
FIGS. 13 and 14 are views of the insert subassembly formed for assembly to a conventional modular jack housing by inserting the front insert member and the leads extending therefrom into the housing and by mating the rear insert member with the housing as shown in FIG. 14.

To position the insert subassembly 6 in the housing 4, the contact terminals 12 are bent downwardly to occupy a position, shown in FIG. 13, in which they will engage contacts on a modular plug positioned in the plug mating cavity 16. The portions of the contact terminals extending between the front insert member 8 and the rear insert member 10 are then bent substantially at right angles. The front insert member 8 is then inserted into the housing 4 and the individual contact terminals 12 extend into the slots formed in the comb 18. A groove extends from the rear channel 20 into the plug mating cavity 16. The front insert member 8 fits into this groove and this interfitting engagement keeps the contact terminals 12 in position. The rear insert 10 is partially inserted into the open ended rear channel 20. Snap latches 32 on the exterior of the insert molded rear insert member body 30 then engage housing latches 28 in the housing rear channel 20 to hold the rear insert in place. To this point the fabrication and assembly of the modular jack 2, to the extent relevant to this invention, is substantially the same as the fabrication and assembly of the modular jack depicted in U.S. Pat. No. 5,362,257.

The modular jack assembly 2 of the preferred embodiments of this invention differ from that depicted in U.S. Pat. No. 5,362,257 because active signal conditioning circuitry is included in this assembly. The signal conditioning circuitry employed with this invention can include a wide variety of components which are encapsulated by the insert molded plastic forming the body of the rear insert member 10. These signal conditioning components can include choke coils, transformers and LC filter as well as other signal conditioning components such as capacitors, ferrite beads and transient suppression diodes. This list of signal conditioning components is not intended to be all inclusive. The signal conditioning circuitry for which this invention is to be used is also not limited to circuitry which can be used to remove noise, although that is one significant application of this invention.

In each representative embodiment of this invention, one or more signal conditioning components are connected between corresponding contact terminals 12 and leads 14 or between corresponding pairs of contact terminals and leads. In many applications, multiple components are used. Three significant configurations should be enumerated. The first configuration is a common mode choke only configuration in which a choke is connected between associated pairs of conductors. Additional signal conditioning can be achieved with a second configuration in which isolation transformers are added. In a third configuration, LC filter circuits are added to form a choke-transformer-filter circuit. Other permutations and combinations are also possible.

Figure 5:
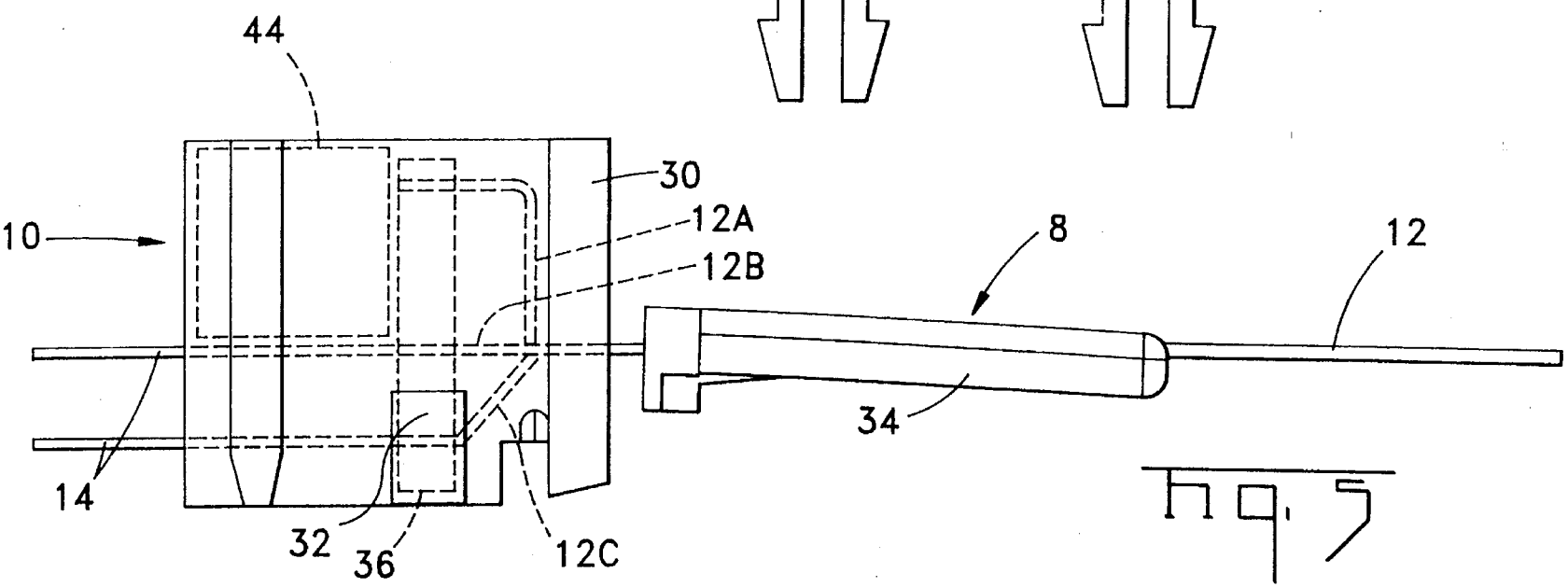
FIG. 5 is a view of a first embodiment of this invention showing the position of the components in the signal conditioning insert member.

For those embodiments which employ more than just a choke or just a transformer, the signal conditioning components are mounted on a signal conditioning printed circuit board 36 encapsulated within the insert molded body 30 of the rear insert member 10. A choke only configuration can also employ a signal conditioning printed circuit board. FIG. 5 is an example of one such embodiment. The contact terminals 12 and the leads 14, at least for the effected lines, are separately soldered to the printed circuit board 36. As shown in FIG. 5, the contact terminals 12 extend through the insert molded body 34 of the front insert member. The contact terminals 12 are then formed, as shown by the segments 12A, 12B and 12C. Segments 12A are bent so that they are soldered to the printed circuit board 36 near the top edge. Segments 12B are not bent and can extend through the printed circuit board. Segments 12C are bent so that they are located adjacent the lower edge of the printed circuit board. Not all of the lines in a given application will be connected to signal conditioning components. Therefore some of the contact terminals, for example those represented by segments 12B and 12C, can extend through the printed circuit board. These contact terminals and the printed circuit board leads can then be continuous. The segments represented by segments 12A are not continuous and are not in line with the corresponding printed circuit board leads 14. These segments 12A are connected to the printed circuit board 36, here by soldering the segments 12A in plated through holes on the printed circuit board 36. Printed circuit board traces then connect the contact terminals to signal conditioning components also soldered to the printed circuit board. Other traces on the board connect the signal conditioning components to plated through holes in which printed circuit board leads 14 are soldered. In addition to connecting contact terminals and leads to signal conditioning components, traces on opposite sides of the printed circuit board, corresponding to specific pairs, can crossover to improve the cross talk performance of the connector assembly. The configuration of FIG. 5 is one in which the footprint of the leads 14 in this modular jack 2 conforms to the footprint of the leads in conventional printed circuit board mounted modular jacks. The individual signal conditioning components are not shown in FIG. 5, in part because this configuration can be used with a number of different component combinations. A space 44 to be occupied by the signal conditioning components is however shown in the rear insert member 10. This space is adjacent one surface of the printed circuit board 36. It should be understood that this space in not open. The insert molded plastic of the body 30 conforms to and completely surrounds the signal conditioning components to both protect the components and to stabilize the components and maintain them in a fixed position, thus maintaining constant and predictable characteristics.

Figure 7:
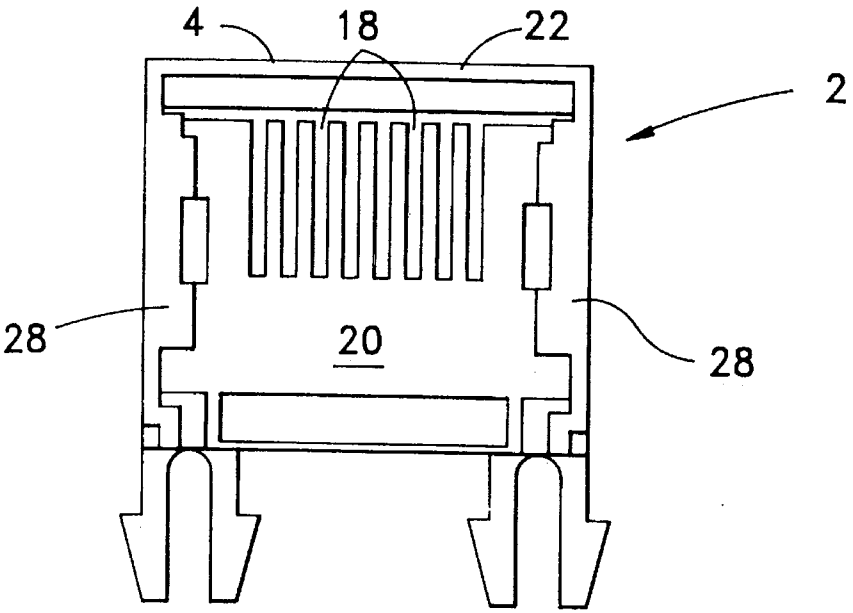
FIG. 7 is a side view of a signal conditioning printed circuit board such as that shown in FIG. 6 with two choke coils and two surface mount filter components mounted on the printed circuit board in the configuration prior to insert molding the signal conditioning insert member.
Figure 6:
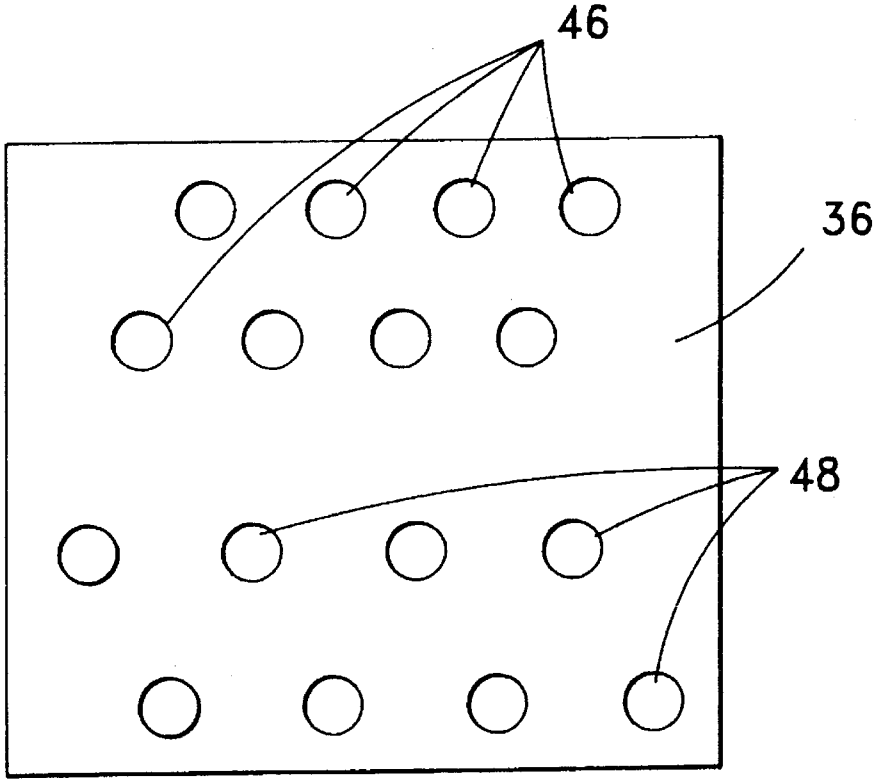
FIG. 6 is a view of a signal conditioning printed circuit board such as would be used in the embodiment of the signal conditioning insert member shown in FIG. 5.

FIG. 6 is a view of one surface of the printed circuit board 36 showing two sets of plated through holes. The first array of holes 48 corresponds to the footprint of the printed circuit board leads 14 and will be located on the device side of board 36 and of the signal conditioning components. The other array of holes 46 are located on the connector or media side and the contact terminals 12 which engage the modular plug. The signal conditioning components are of course located on the printed circuit board between the two arrays 46, 48 of plated through holes. One of the plated through holes 48 in which leads 14 are to be soldered can be a ground reference and components may be connected to a ground lead soldered in this plated through hole. Alternatively, a separate ground lead may be connected to the printed circuit board. FIG. 7 is a side view of this printed circuit board 36 and two choke coils 38 and surface mount chips 40 which form part of a filter are also shown for representative purposes only. FIG. 7 also shows a ground plane 50 on the rear of the printed circuit board. Although the components on the printed circuit board will be grounded, a ground plane covering one side of the component printed circuit board will not be necessary nor desirable in every application. The signal conditioning components shown in FIG. 7 are attached to the board by a thin layer 42 of a conventional bonding agent which serves to initially mechanically secure the components to the printed circuit board. After the components are mounted and then soldered to the printed circuit board and after the contact terminals 12 and the leads 14 are soldered in their corresponding plated through holes, this subassembly is placed in a mold and the rear insert member body 30 is molded around the components and leads on the printed circuit board to stabilize and protect each connection and this entire signal conditioning assembly.

The embodiment of FIG. 8 has a different lead footprint than the embodiment of FIG. 5. The component space 44' is also located in a different position than the component space 44 in the embodiment of FIG. 5. This reconfiguration of the component space 44' and of the leads 14 is due to the different shape of the contact terminal segments 12A' and 12B'. Comparison of FIG. 8 with FIG. 5 shows that forming of the segments 12A' and 12B' in FIG. 8 is simpler, resulting in a simpler assembly of the terminal segments in the plated through holes in the printed circuit board. However, positioning the terminal segments at the lower edge of the printed circuit board 36' means that the printed circuit board leads 14 must now be attached to the top of the printed circuit board. As will be apparent from examination of FIGS. 13 and 14, which are representative of this embodiment, the position of the printed circuit board leads 14 will be adjacent the back of rear insert member 10 with this embodiment. In the embodiment of FIG. 5, the printed circuit board leads 14 are more closely adjacent the front of the rear insert member 10. The depth of the rear insert member can be expected to change as more signal conditioning components are included, and the size of the space 44' increases. Therefore, the position of the leads 14 at the rear of this space 44' in the embodiment of FIG. 8 will be a function of the number and size of the signal conditioning components. In the embodiment of FIG. 5, the location of the leads need not be affected by the size and number of signal conditioning components. The lead footprint of the embodiment of FIG. 5 will therefore remain unchanged and will be substantially the same as for a conventional modular jack connector. In the embodiment of FIG. 8 each printed circuit board lead is soldered to the printed circuit board, even if that lead is not used for the specific application. In some cases where mechanical rigidity is an issue unused leads will be soldered. Where mechanical rigidity is not an issue, unused leads can be omitted. The embodiment of FIG. 5 permits some leads to be an unbroken continuation of the contact terminals and does not require that all leads be soldered to the printed circuit board.

Figure 9:
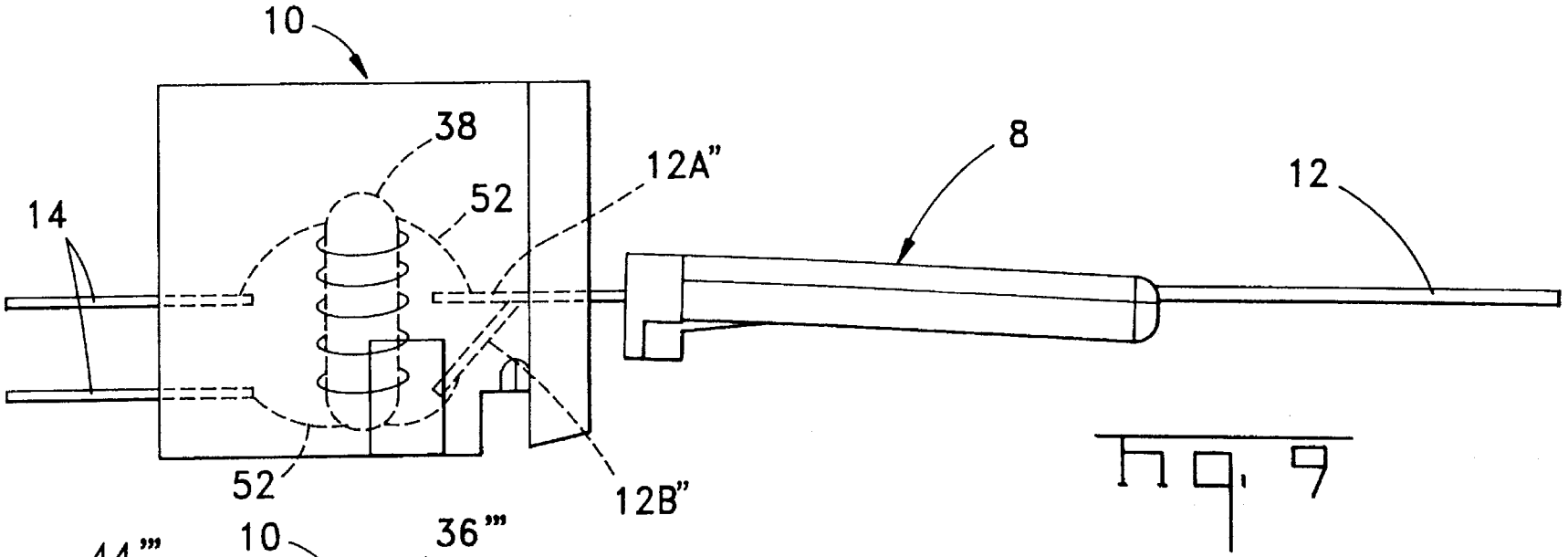
FIG. 9 is a view, similar to FIG. 5, of a third embodiment of this invention in which choke coils are attached directly to the contact terminals and to the leads without the use of a printed circuit board.

The embodiment of FIG. 9 represents a simplification over the embodiments of both FIGS. 5 and 8. In this embodiment individual signal components are soldered directly to the contact terminals 12 and to the corresponding printed circuit board leads 14. The signal condition component is not mounted on a printed circuit board. This embodiment shows a choke coil 38 in which the coil leads 52 are soldered to contact terminal segments 12A" and 12B" and to two printed circuit board leads 14. The choke coil 38 and the terminal and lead attachments are still insert molded as with the other embodiments. The disadvantage of this embodiment of this invention is that the number and complexity of signal components which can be employed is limited by the absence component packaging afforded by the printed circuit board. This embodiment is best suited for applications in which only a single component or identical components on different lines are required.

Figure 10:
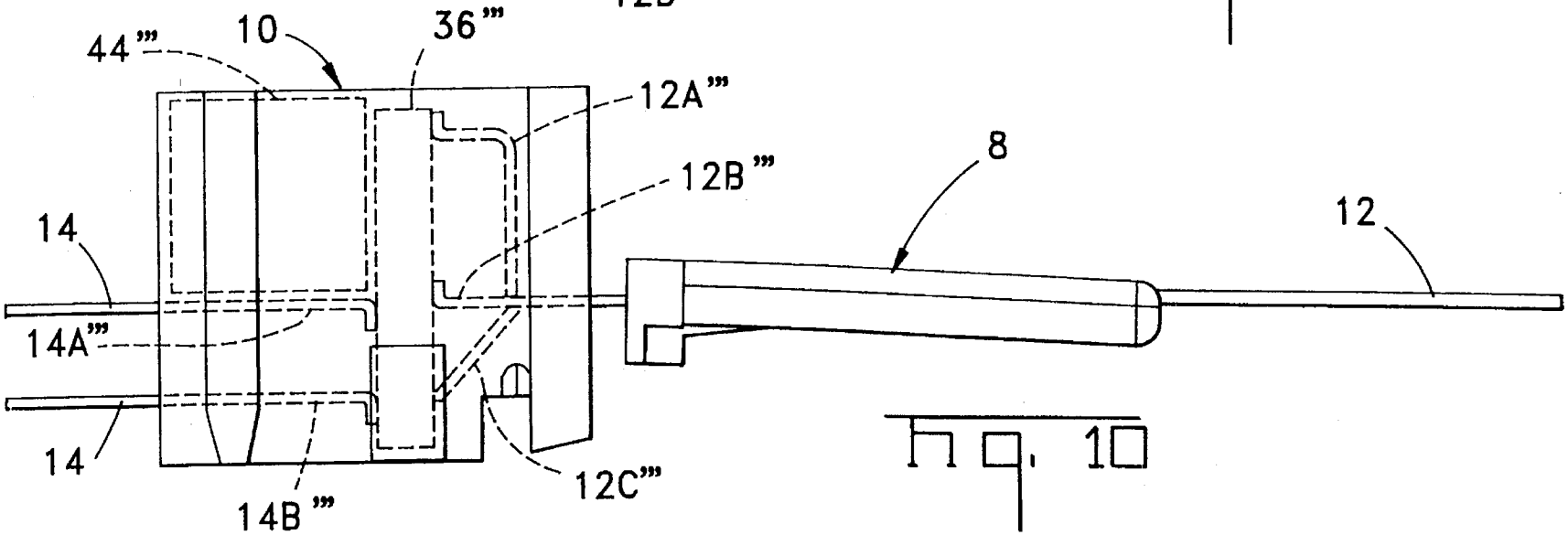
FIG. 10 is a view, similar to FIG. 5, of a fourth embodiment of this invention in which the leads and the contact terminals are attached to the printed circuit board with surface mount connections.
Figures 11, 12:
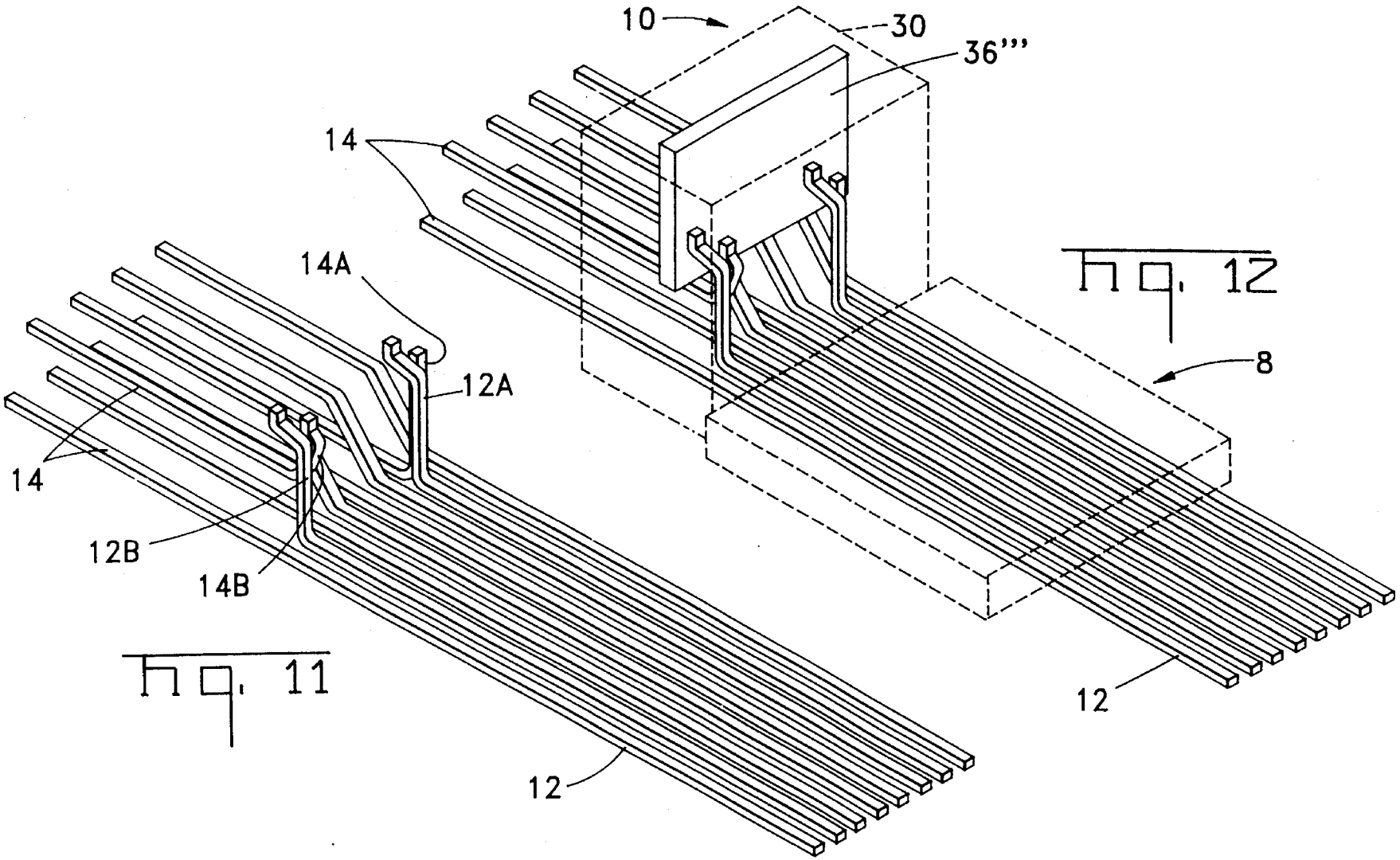
FIGS. 11 and 12 are views of the manner in which selected leads could be attached to a printed circuit board by a surface mount connection while other leads could bypass the printed circuit board.

FIG. 10 is another version of this invention in which the contact terminals 12 and the printed circuit board leads are soldered to a printed circuit board in the rear insert member 10. In this configuration, the contact terminal segments 12A''', 12B''' and 12B''' soldered to printed circuit board 36''' and the lead segments 14A''' and 14B''' soldered to printed circuit board 36''' are surface mount leads. Otherwise the configuration of FIG. 10 is substantially the same as the configuration of FIG. 5. The use of surface mount leads instead of through hole leads simplifies the assembly and soldering processes and lends itself to automation. FIGS. 11 and 12 show the manner in which contact terminals 12 and printed circuit board leads 14 can be soldered to a printed circuit board using a surface mount soldering process. This example shows two sets of leads being soldered to the printed circuit board. Notice that all of the remaining leads completely bypass the printed circuit board 36'''. Thus any leads which are unused, or which do not need the signal conditioning afforded by this invention need not be attached or soldered to the printed circuit board. Elimination of these solder joints simplifies assembly and will inherently increase the reliability of the finished product. Although FIGS. 11 and 13 show only the leads soldered to the printed circuit board with right angle bends, it should be understood that the other leads would have to be bent into position before being insert molded into the rear insert body 30, which is shown here only in phantom. FIGS. 11 and 12 are intended to be illustrative only and other surface mount assembly techniques can be employed. For example the printed circuit board could be place below the straight leads and the surface mount pads on the affected leads would be the formed out of this plane. Since the printed circuit board leads would be staggered, half of the leads would still have the offset section. The insert molded rear body 30 and the front insert molded body 34 would then be molded in the same orientation. Afterwards all of the leads would be formed into the right angle configuration shown in FIG. 1 and in FIGS. 13 and 14.

FIGS. 13 and 14 show that the rear insert member 10 has been formed at right angles relative to the front insert member 8 prior to mating the insert subassembly 6 with the modular jack insulative housing 4. All contact terminals including segments 12A and 12B which extend between the front insert member 8 and the rear insert member 10 are bent at right angles to form the insert subassembly 6 into this configuration. In this configuration, the rear insert subassembly 6 can be mated with the housing 4 by partially inserting the insert subassembly 6 into the open ended rear channel 20. As shown in FIG. 14, the rear insert member 10 is not fully inserted into the housing 4. Since the depth of the rear insert member 10 is a function of the size, shape and number of signal conditioning components used for the specific application of this invention, the rear of the housing must be open ended and the rear insert member will not necessarily be encased in the housing 4. Although FIGS. 13 and 14 show the insert subassembly embodiment of FIG. 8, it should be understood that each of the embodiments is formed in this manner.

Figure 15:
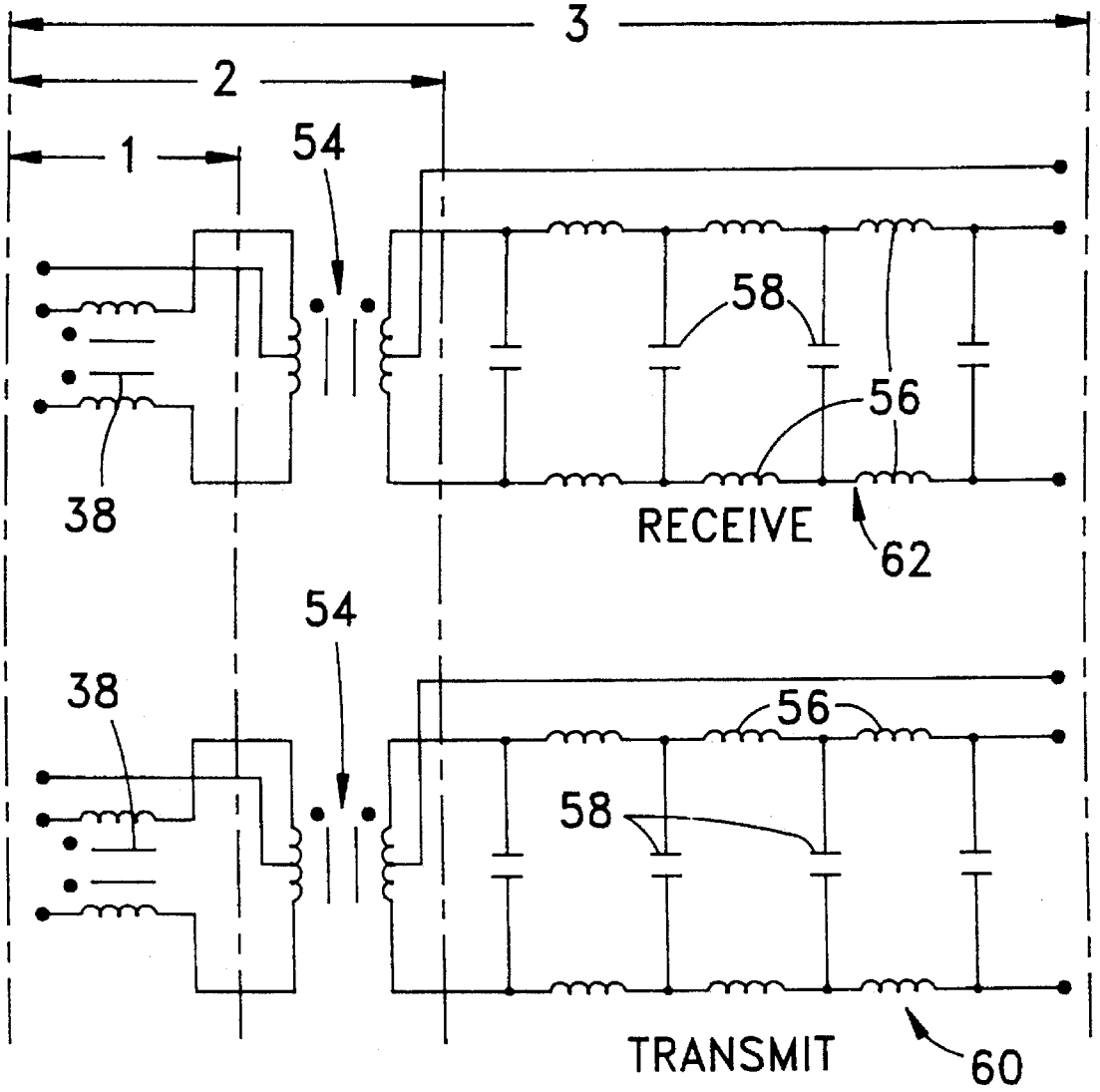
FIG. 15 is a schematic of the circuit which could be included in the signal conditioning insert member for use in a 10 Base T local area network application.

One of the advantages of this invention is that it can be used for different applications requiring different signal conditioning circuits. FIG. 15 is a schematic of a signal conditioning circuit which could be employed for an IEEE 802.3 10Base T network. This circuit includes choke coils 38, transformers 54 and an LC filter circuit comprising inductors (L) 56 and capacitors (C) 58 in both a transmit circuit 60 and a receive circuit 62. This LC as well as the choke coils and transformers are available as complete components which can be soldered to the printed circuit board 36. All of these components can be included on a printed circuit board and in a rear insert member which would extend approximately 0.600 in beyond the rear of the modular jack housing 4. Even so, the size of the entire modular jack assembly still remains quite small and will result in a saving of real estate on the main interface printed circuit board used for the networks device with which this modular jack assembly is used.

The embodiments depicted herein represent different examples of this invention intended primarily for network interface applications. This invention can however by used in other embodiments and for other applications, and the claims presented herein are not limited to the specific embodiments chosen as representative examples. In some cases, specific alternatives have been mentioned. For example, this invention could be used in top entry jacks, in jacks or connectors other than modular jacks, in multi-cavity modular jack blocks, and for jacks which are not mounted on printed circuit boards.. These specific alternatives are also intended to be representative and not exclusive.

I claim:

1. A modular jack assembly for use in conditioning signals carried by wires comprising:

a housing including a cavity for receiving a modular plug:

an insert subassembly further comprising;

a plurality of contact terminals, the insert subassembly being insertable into the housing such that the contact terminals extend into the cavity and are positioned for engaging the modular plug, a plurality of leads, at least one signal conditioning component connected to corresponding leads and contact terminals, and an insert molded body matable with the housing, the insert molded body positioning the leads for attachment to external circuits and the insert molded body encapsulating the signal conditioning components wherein the housing includes a open ended channel at the rear thereof in which the insert molded body is partially received, the insert molded body protruding from the channel at the rear of the housing.

* * * * *